US005211542A

United States Patent [19]

Fraser et al.

[11] Patent Number: 5,211,542

[45] Date of Patent: May 18, 1993

[54] METHOD AND APPARATUS FOR OIL SUMP PRESSURE CONTROL

[75] Inventors: Bruce A. Fraser, Manlius; Michael J. Dormer, Fabius, both of N.Y.

[73] Assignee: Carrier Corporation, Syracuse, N.Y.

[21] Appl. No.: 962,542

[22] Filed: Oct. 19, 1992

[51] Int. Cl.[5] ..... F04B 47/08

[52] U.S. Cl. ..... 417/53; 417/228; 417/295; 184/6.23

[58] Field of Search ..... 417/295, 228, 279, 281, 417/309, 53; 184/6.23

[56] References Cited

U.S. PATENT DOCUMENTS

| | | | |
|---|---|---|---|
| 2,741,424 | 4/1956 | Ploeger | 417/295 X |
| 3,367,562 | 2/1968 | Persson et al. | 417/295 |
| 4,580,950 | 4/1986 | Sumikawa et al. | 417/295 |

*Primary Examiner*—Richard E. Gluck

[57] ABSTRACT

In a compressor having an oil sump located therein, a restricted communication is provided between the oil sump and the suction plenum. As a result, froth generation due to a rapid pressure drop in the oil sump is reduced. A relief valve is provided to limit the pressure differential between the suction plenum and the oil sump.

3 Claims, 2 Drawing Sheets

METHOD AND APPARATUS FOR OIL SUMP PRESSURE CONTROL

BACKGROUND OF THE INVENTION

During compressor shutdown, refrigerant accumulation and absorption takes place in the oil sump or crankcase and thereby dilutes the lubrication oil resulting in a refrigerant and oil mixture. The refrigerant condenses and accumulates in the compressor because it tends to be one of the lowest temperature points in the system, due to the thermal gradient in the system and because of the affinity of halocarbon refrigerants for oil. Under normal operating conditions, some oil circulates with the refrigerant and will be returned to the compressor oil sump during continuous operation. In the case of a low side compressor, the casing will generally have an equilibrium pressure, after shutdown, which is greater than the suction pressure during operation. With the oil sump being directly connected to the suction plenum, their equilibrium pressures are identical. This will cause liquid refrigerant to migrate to the oil sump and a flooded start condition will exist because of the refrigerant in the sump. Specifically, at start up, the suction plenum and thus the pressure of the gaseous refrigerant over the oil sump, will be drawn down towards suction pressure. However, as the pressure in the suction plenum and oil sump is reduced, the liquid refrigerant in the oil starts boiling off creating a froth or foam. Froth will be generated as long as the pressure is being reduced in the oil sump and refrigerant is dissolved in the oil. As a result, the oil pump draws in froth rather than liquid oil and delivers gaseous refrigerant to the lubrication system. Pumping gas prevents the system from developing oil pressure and the gaseous refrigerant interferes with the lubrication process.

SUMMARY OF THE INVENTION

The oil sump and suction plenum of a low side compressor are in restricted fluid communication. Specifically, a relief valve with a restricted bypass controls fluid communication between the suction plenum and the oil sump. Normally, the orifice providing the restricted bypass will require on the order of two to ten minutes to bring the oil sump pressure down to suction pressure. Over this relatively long time period, the froth generation due to the slowly falling pressure is not sufficient to significantly interfere with the pumping of oil. The relief valve limits the maximum pressure differential and resulting bearing loads. Additionally, the relief valve protects the compressor in the event that the pressure control orifice becomes plugged.

It is an object of the invention to improve oil pressure response under "flooded start" conditions.

It is another object of this invention to control the rate at which the refrigerant is allowed to "boil" out of compressor sump oil during a flooded start.

It is an additional object of this invention to maintain oil pressure in a lubrication system.

It is a further object of this invention to prevent vapor locking of a compressor oil pump during a flooded start. These objects, and others as will become apparent hereinafter, are accomplished by the present invention.

Basically, a restricted communication is continuously provided between an oil sump and a suction plenum such that pressure equalization takes place at a controlled rate so as to control boiling off of refrigerant in the sump during a flooded start. Additionally, a relief valve is provided to control the maximum pressure differential between the sump and suction plenum. Preferably, the restricted communication is incorporated into the relief valve.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 1:
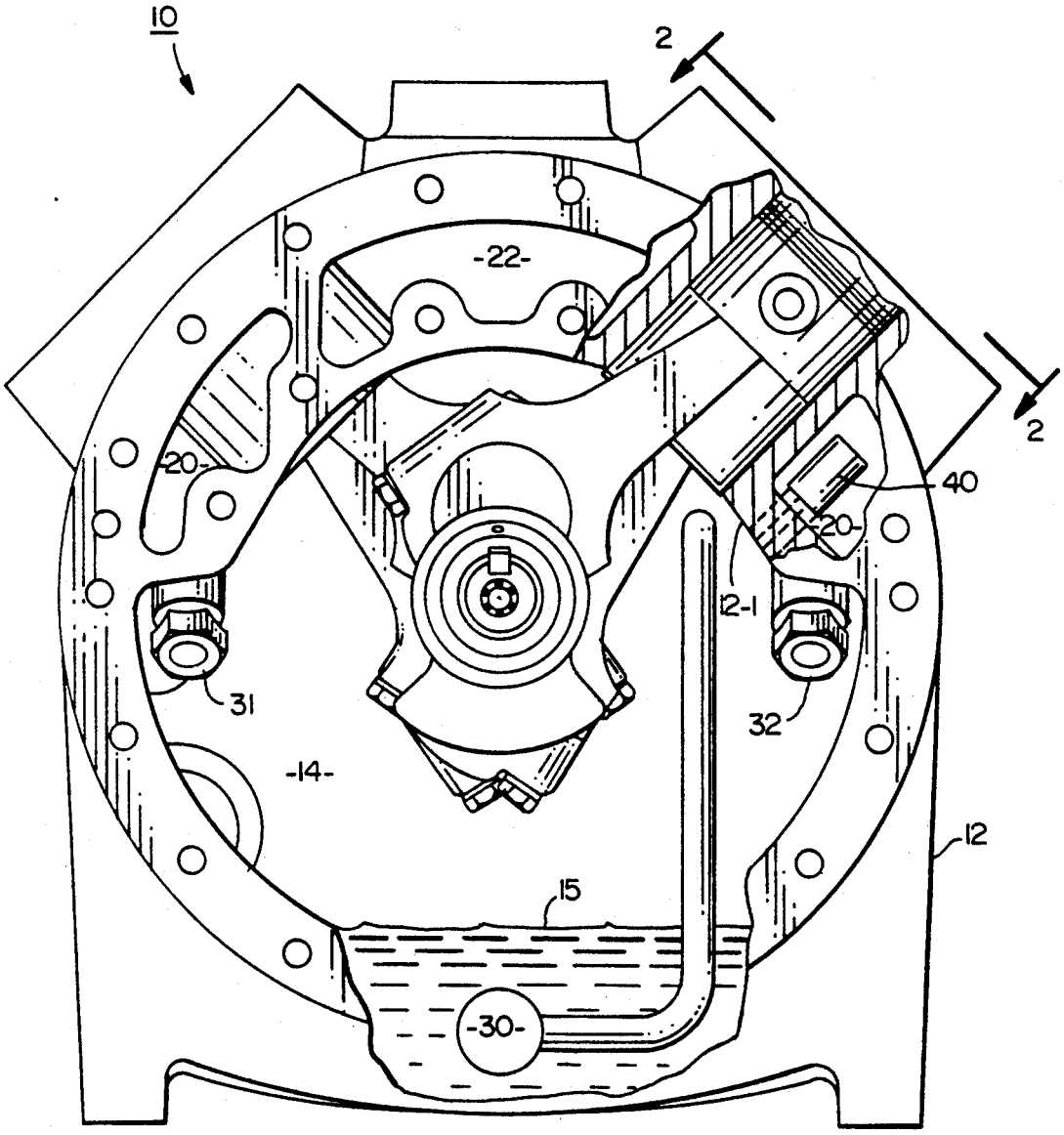
FIG. 1 is a partially cutaway view of a compressor housing with the heads and end cover removed.
Figure 2:
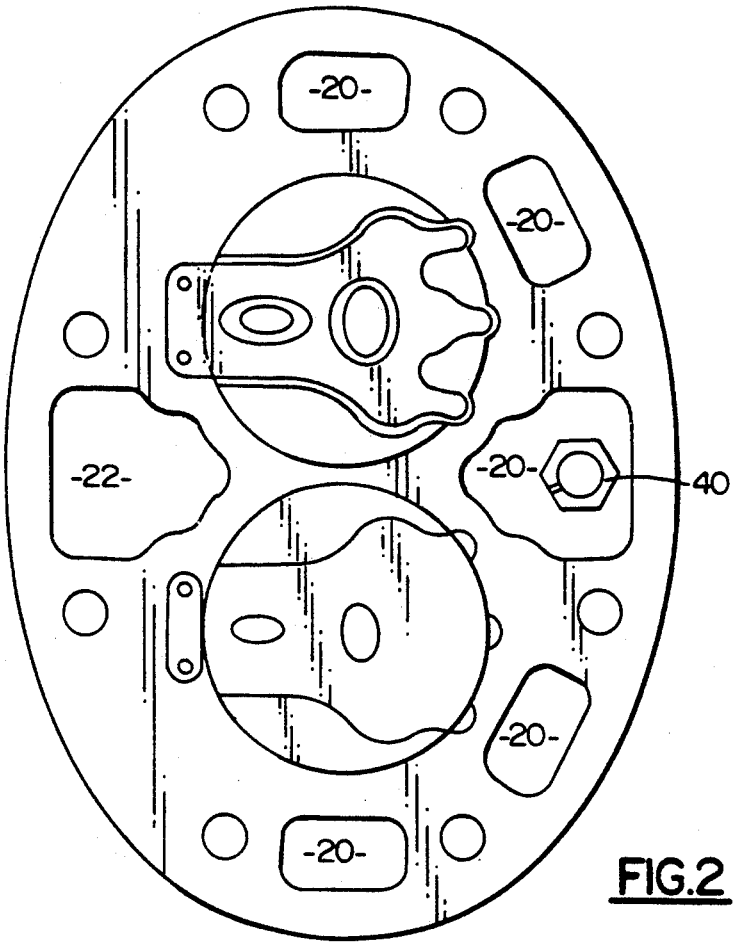
FIG. 2 is a view taken along line 2—2 of FIG. 1.
Figure 3:
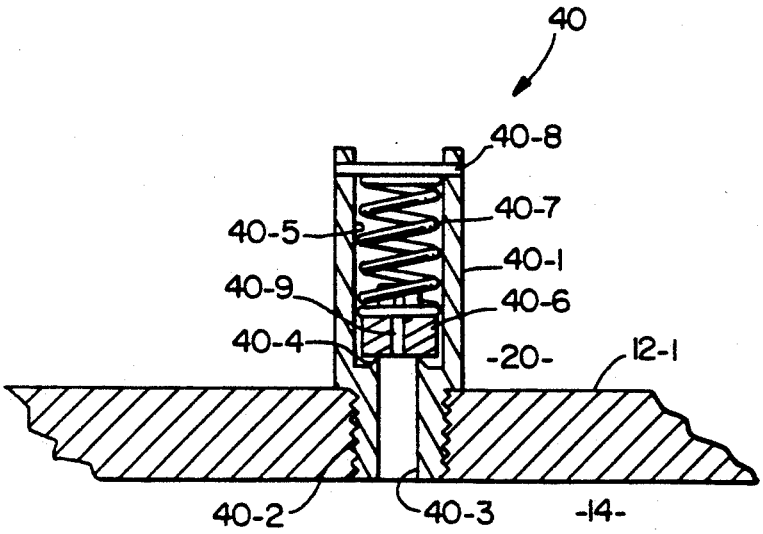
FIG. 3 is a sectional view through the orifice and relief valve assembly.

In FIG. 1, the numeral 10 generally designates a low side semi-hermetic compressor having a casing 12. As illustrated, compressor 10 is a four-cylinder reciprocating compressor with the heads removed. FIG. 2 shows two cylinders with the suction valve removed from the lower cylinder. Casing 12 is divided into an oil sump 14 containing gaseous refrigerant with liquid oil 15 located therein, suction plenum 20 and discharge plenum 22. As is clear from FIGS. 1 and 2, suction plenum 20 is made up of a plurality of chambers formed in casing 12. At one location, oil sump 14 is separated from suction plenum 20 by wall or partition 12-1 having a threaded bore 12-2 as is best shown in FIG. 3. Orifice and relief valve assembly 40 has a housing 40-1 having a threaded portion 40-2 which is threadably received in threaded bore 12-2. Bore 40-3 extends through threaded portion 40-2 and terminates in knife edge seat 40-4. Valve bore 40-5 extends through housing 40-1 and forms a continuous flow path with bore 40-3. Normally closed valve member 40-6 is located in bore 40-5 and is biased onto seat 40-4 by spring 40-7. Spring 40-7 is held in bore 40-5 in a compressed state by pin 40-8 which extends through housing 40-1 and across bore 40-5. Valve member 40-6 has a restricted orifice 40-9 extending therethrough and providing continuous, restricted fluid communication between oil sump 14 and suction plenum 20. The size of orifice 40-9 is determined by the desired rate of pressure drop, and, hence, refrigerant boil off, in oil sump 14 during a flooded start. These, in turn, will be influenced by the specific refrigerant and lubricant combination and the resultant refrigerant charge, affinity between the refrigerant and lubricant, and ambient conditions encountered. An orifice diameter of 0.042 inches has operated satisfactorily in conjunction with refrigerant R-12 and R-22.

In operation, assuming that compressor 10 has been shutdown and the refrigerant system has equalized, the gaseous refrigerant in oil sump 14, the oil 15, the suction plenum 20 and the discharge plenum 22 will initially be at the same pressure and the oil 15 will have a significant amount of refrigerant contained therein. As compressor 10 starts to run, refrigerant vapor is drawn from the suction plenum 20, compressed, and the compressed refrigerant is delivered to the discharge plenum 22 from which it passes to the refrigeration system. The drawing of refrigerant vapor from suction plenum 20 causes refrigerant vapor to be drawn into the suction plenum 20 from the refrigeration system. The drawing of refrigerant vapor from the suction plenum 20 has a major effect on the oil sump 14. If there is a reasonable degree of communication, the oil sump 14 effectively becomes part of the suction plenum 20. Unlike in the suction plenum 20, the drawing off of refrigerant vapor from the oil sump 14 causes a boiling off of refrigerant from the oil 15 with a resulting generation of froth. The froth generation, however, is the major problem since the boiling out of refrigerant results in froth, rather than liquid oil, being drawn into oil pump inlet 30. As a result, the oil pump delivers insufficient oil as well as undesired gaseous refrigerant to the parts requiring lubrication. The oil pump is likely to become vapor locked with bearing damage and failure occurring under these conditions. Oil returns to oil sump 14 via oil return check valves 31 and 32 which are, typically, metal disc valve elements which are normally open but readily closed with a small pressure differential in the direction of reverse flow such as at start up.

By restricting communication between oil sump 14 and suction plenum 20, the rate of pressure reduction in the oil sump 14 and thereby the rate of boiling off of refrigerant and the generation of froth in the oil 15 is reduced. The reduced froth generation permits liquid oil rather than froth to be drawn into oil pump inlet 30. As a result, liquid oil can be supplied to the lubrication system during the stabilization process at start up. Under stabilized operating conditions, the oil sump 14 and suction plenum 20 will be at the same pressure and the oil 15 in the sump will be heated in serving its lubrication function thereby driving most of the refrigerant from the oil. To achieve the desired rate of pressure reduction in the crankcase, orifice 40-9 must be sized to permit the passage of the pressurized gaseous refrigerant from the oil sump as well as the boiled off refrigerant from the oil 15 to the suction plenum 20.

Necessarily, a restricted orifice has a finite flow rate and is at a higher risk of being further restricted if clogged. Valve 40-6 opens against the bias of spring 40-7 to relieve any excessive pressure differential between oil sump 14 and suction plenum 20. The excessive pressure differential can be caused by the inherent time delay in pressure equalization through orifice 40-9 coupled with a relatively quick draw down of the suction plenum. It can also be due to initial conditions in the oil sump 14 and oil 15 due to ambient temperature, and/or due to blockage of orifice 40-9. Responsive to an excessive pressure differential thereacross, valve 40-6 is opened against the bias of spring 40-7. The valve 40-6 will remain open only as long as the pressure differential is sufficient to overcome the spring bias so that the oil sump 14 will remain pressurized to the desired pressure differential even if valve 40-6 is opened to relieve pressure in the oil sump 14. As a result, the froth generation under conditions causing valve 40-6 to function as a relief valve will be less severe and will not be sufficient to cause vapor locking of the lubrication system. When the pressure in oil sump 14 drops to that in the suction plenum 20, valves 31 and 32 will open to permit the return of oil to oil sump 14.

Although a preferred embodiment of the present invention has been illustrated and described, other modifications will occur to those skilled in the art. For example, the orifice can be made separate from the valve structure and may be located elsewhere in the valve structure such as at the interface of the valve member and seat. Also, the orifice could be controlled based upon sensed pressure. It is therefore intended that the present invention is to be limited only by the scope of the appended claims.

We claim:

1. A method for oil sump pressure control in a low side semi-hermetic compressor comprising the steps of:

providing continuous restricted fluid communication between the oil sump and a suction plenum;

responsive to a predetermined pressure differential between said oil sump and said suction plenum, providing a freer communication between said oil sump and said suction plenum to thereby limit the differential pressure to said predetermined pressure differential whereby flashing of refrigerant in said oil sump is controlled.

2. An oil sump pressure control for a semi-hermetic low side compressor comprising:

a casing means defining an oil sump and a suction plenum;

oil located in said oil sump;

a restricted fluid communication path between said oil sump and said suction plenum with said restricted path providing the only normal fluid communication between said oil sump and suction plenum at start up whereby pressure equalization between said oil sump and said suction plenum takes place at a controlled rate such that refrigerant in said oil sump also boils off at a controlled rate; and relief means for limiting a pressure differential between said oil sump and said suction plenum.

3. The control of claim 2 wherein said relief means is a normally biased closed valve means and said restricted path is located therein.

* * * * *